US010535293B2

(12) United States Patent
Hwang et al.

(10) Patent No.: US 10,535,293 B2
(45) Date of Patent: Jan. 14, 2020

(54) DISPLAY DEVICE PERFORMING LOW GRAY SINGLE COLOR IMAGE COMPENSATION, AND METHOD OF OPERATING THE DISPLAY DEVICE

(71) Applicant: Samsung Display Co., Ltd, Yongin-Si, Gyeonggi-Do (KR)

(72) Inventors: Jun-Ho Hwang, Asan-si (KR); Choonyul Oh, Seongnam-si (KR); Sunjoon Hwang, Cheonan-si (KR); Dongjun Han, Cheonan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 36 days.

(21) Appl. No.: 15/993,946

(22) Filed: May 31, 2018

(65) Prior Publication Data

US 2019/0189045 A1 Jun. 20, 2019

(30) Foreign Application Priority Data

Dec. 18, 2017 (KR) ..... 10-2017-0174600

(51) Int. Cl.
*G09G 3/20* (2006.01)

(52) U.S. Cl.
CPC ..... *G09G 3/2074* (2013.01); *G09G 3/2003* (2013.01); *G09G 2300/0452* (2013.01); *G09G 2320/0242* (2013.01); *G09G 2320/0276* (2013.01); *G09G 2320/0626* (2013.01)

(58) Field of Classification Search
CPC ..... G09G 3/2074; G09G 3/3607; G09G 2300/0439–0465; G09G 2320/02–0295; G09G 2320/06–0693; G09G 2340/0428; G09G 2340/06; H04N 1/6008
USPC ..... 345/89, 690–697
See application file for complete search history.

(56) References Cited

U.S. PATENT DOCUMENTS

| | | | | |
|---|---|---|---|---|
| 9,542,728 | B2 | 1/2017 | Lee et al. | |
| 2018/0040270 | A1* | 2/2018 | Won | G09G 3/2092 |
| 2018/0136501 | A1* | 5/2018 | Yamamoto | G02F 1/13306 |

* cited by examiner

*Primary Examiner* — Amr A Awad
*Assistant Examiner* — Aaron Midkiff
(74) *Attorney, Agent, or Firm* — Cantor Colburn LLP

(57) ABSTRACT

In a method of operating a display device, it is determined whether an image represented by input image data is a single color image, it is determined whether the image represented by the input image data is a low gray image, compensated image data are generated by adding sub-pixel data corresponding to a color different from a color of the single color image to the input image data when the image represented by the input image data is the single color image and the low gray image, and an image is displayed based on the compensated image data.

19 Claims, 12 Drawing Sheets

DISPLAY DEVICE PERFORMING LOW GRAY SINGLE COLOR IMAGE COMPENSATION, AND METHOD OF OPERATING THE DISPLAY DEVICE

This application claims priority to Korean Patent Application No. 10-2017-0174600, filed on Dec. 18, 2017, and all the benefits accruing therefrom under 35 U.S.C. § 119, the content of which in its entirety is herein incorporated by reference.

BACKGROUND

1. Field

Exemplary embodiments of the invention relate to display devices, and more particularly to display devices performing low gray single color image compensation and methods of operating the display devices.

2. Description of the Related Art

When a single color image is displayed by a display device, such as an organic light emitting display device, the single color image may not have desired luminance because of coupling between a pixel emitting light and an adjacent pixel not emitting light.

SUMMARY

A luminance degradation of a single color image may be worse in a case where the single color image is a low gray (or low luminance) image. In particular, when a low gray single color image or a low luminance single color image is displayed, a gradation aggregation phenomenon in which image portions corresponding to adjacent low gray levels are not distinguished may occur.

Some exemplary embodiments provide a method of operating a display device capable of improving an image quality of a low gray single color image.

Some exemplary embodiments provide a display device capable of improving an image quality of a low gray single color image.

According to an exemplary embodiment, there is provided a method of operating a display device. In the method, it is determined whether an image represented by input image data is a single color image, it is determined whether the image represented by the input image data is a low gray image, compensated image data are generated by adding sub-pixel data corresponding to a color different from a color of the single color image to the input image data when the image represented by the input image data is the single color image and the low gray image, and an image is displayed based on the compensated image data.

In an exemplary embodiment, the input image data may include first sub-pixel data for a first color sub-pixel, second sub-pixel data for a second color sub-pixel, and third sub-pixel data for a third color sub-pixel, and it may be determined that the image represented by the input image data is the single color image when one of the first through third sub-pixel data has a gray level value other than 0 and the remaining two of the first through third sub-pixel data have a gray level value of 0.

In an exemplary embodiment, it may be determined that the image represented by the input image data is the low gray image when gray level values of the input image data are lower than a reference gray level value.

In an exemplary embodiment, the reference gray level value may be a predetermined constant value.

In an exemplary embodiment, the reference gray level value may be changed according to a dimming level of the display device.

In an exemplary embodiment, the input image data may be output as the compensated image data when the image represented by the input image data is not the single color image or when the image represented by the input image data is not the low gray image.

In an exemplary embodiment, the sub-pixel data added to the input image data may have a gray level value of 1.

In an exemplary embodiment, the sub-pixel data added to the input image data may have a gray level value greater than 0 and less than or equal to 1.

In an exemplary embodiment, the sub-pixel data added to the input image data may have a gray level value that is proportional to a gray level value of the input image data.

In an exemplary embodiment, the sub-pixel data added to the input image data may have a gray level value that is proportional to a dimming level of the display device.

In an exemplary embodiment, the compensated image data may be generated by adding green sub-pixel data to the input image data when the image represented by the input image data is a single red image, and the compensated image data may be generated by adding red sub-pixel data to the input image data when the image represented by the input image data is a single green image.

In an exemplary embodiment, the compensated image data may be generated by adding green sub-pixel data and blue sub-pixel data to the input image data when the image represented by the input image data is a single red image, and the compensated image data may be generated by adding red sub-pixel data and the blue sub-pixel data to the input image data when the image represented by the input image data is a single green image.

In an exemplary embodiment, determining whether the image is the single color image, determining whether the image is the low gray image and generating the compensated image data may be performed per each pixel of the display device.

In an exemplary embodiment, a plurality of pixels of the display device are grouped into a plurality of pixel blocks, and determining whether the image is the single color image, determining whether the image is the low gray image and generating the compensated image data may be performed per each pixel block.

In an exemplary embodiment, determining whether the image is the single color image, determining whether the image is the low gray image and generating the compensated image data may be performed per each frame of the display device.

According to an exemplary embodiment, there is provided a method of operating a display device including a first color sub-pixel, a second color sub-pixel and a third color sub-pixel. In the method, it is determined whether an image represented by input image data is a single color image that is displayed such that only one of the first through third color sub-pixels emits light, it is determined whether the image represented by the input image data is a low gray image lower than a reference gray level value, compensated image data are generated by adding sub-pixel data for at least one of remaining two of the first through third color sub-pixels not emitting light to the input image data when the image represented by the input image data is the single color image and the low gray image, and an image is displayed based on the compensated image data.

According to an exemplary embodiment, there is provided a display device including a display panel including a first color sub-pixel, a second color sub-pixel and a third color sub-pixel, and a display driver which drives the display panel. The display driver further determines whether an image represented by input image data is a single color image that is displayed such that only one of the first through third color sub-pixels emits light, to determine whether the image represented by the input image data is a low gray image lower than a reference gray level value, to generate compensated image data by adding sub-pixel data for at least one of remaining two of the first through third color sub-pixels not emitting light to the input image data when the image represented by the input image data is the single color image and the low gray image, and to drive the display panel based on the compensated image data.

In an exemplary embodiment, the display driver may include a single color image determiner which determines that the image represented by the input image data is the single color image when one of first through third sub-pixel data included in the input image data respectively for the first through third color sub-pixels has a gray level value other than 0 and the remaining two of the first through third sub-pixel data have a gray level value of 0, a low gray image determiner which determines that the image represented by the input image data is the low gray image when gray level values of the input image data are lower than the reference gray level value, and a compensated image data generator which outputs the input image data as the compensated image data when the image represented by the input image data is not the single color image or when the image represented by the input image data is not the low gray image, and generates the compensated image data by adding the sub-pixel data for at least one of the remaining two of the first through third color sub-pixels not emitting light to the input image data when the image represented by the input image data is the single color image and the low gray image.

In an exemplary embodiment, the display driver may further include an additional data gray value table which stores a gray level value of the sub-pixel data added to the input image data according to a gray level value of the input image data or a dimming level of the display device. The compensated image data generator may generate the compensated image data by adding the sub-pixel data having the gray level value stored in the additional data gray value table to the input image data.

In an exemplary embodiment, the display driver may further include a maximum gray value storing unit which stores a maximum additional data gray level value corresponding to a maximum gray level value or a maximum dimming level, and a minimum gray value storing unit which stores a minimum additional data gray level value corresponding to a minimum gray level value or a minimum dimming level. The compensated image data generator may calculate an additional data gray level value corresponding to a gray level value of the input image data or a dimming level of the display device by performing a linear interpolation between the maximum additional data gray level value and the minimum additional data gray level value, and may generate the compensated image data by adding the sub-pixel data having the calculated additional data gray level value to the input image data.

As described above, when an image represented by input image data is a single color image and a low gray image, the method of operating the display device, and the display device according to exemplary embodiments may add sub-pixel data corresponding to a color different from a color of the single color image to the input image data, thereby improving an image quality of the low gray single color image.

BRIEF DESCRIPTION OF THE DRAWINGS

Illustrative, non-limiting exemplary embodiments will be more clearly understood from the following detailed description in conjunction with the accompanying drawings.

DETAILED DESCRIPTION

Figure 1:
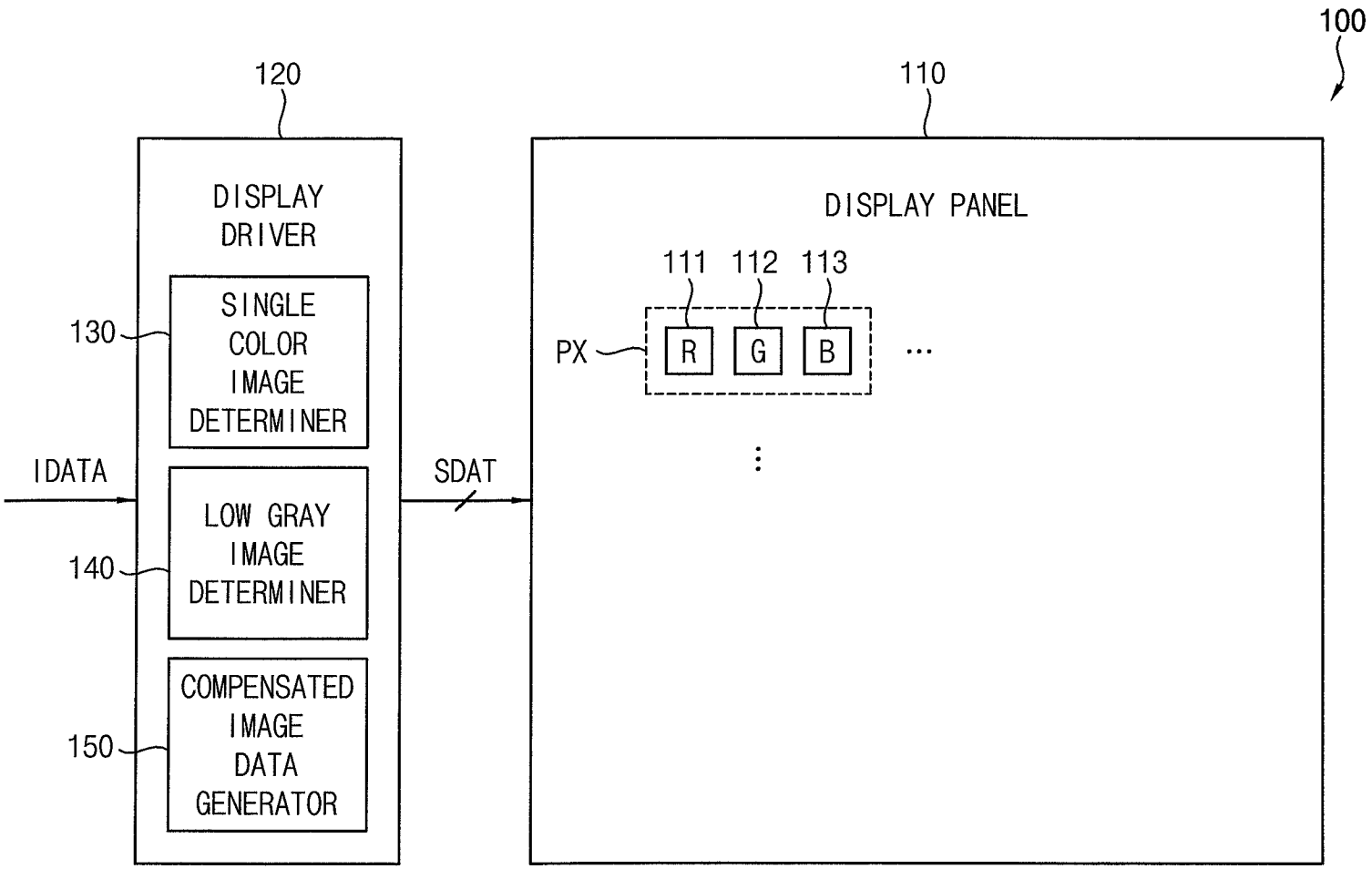
FIG. 1 is a block diagram illustrating an exemplary embodiment of a display device.

Hereinafter, embodiments of the invention will be explained in detail with reference to the accompanying drawings. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be there between. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Figure 2:
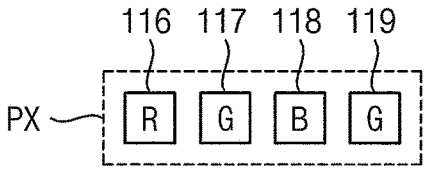
FIG. 2 is a diagram illustrating another example of a pixel included in a display device of FIG. 1.
Figure 3:
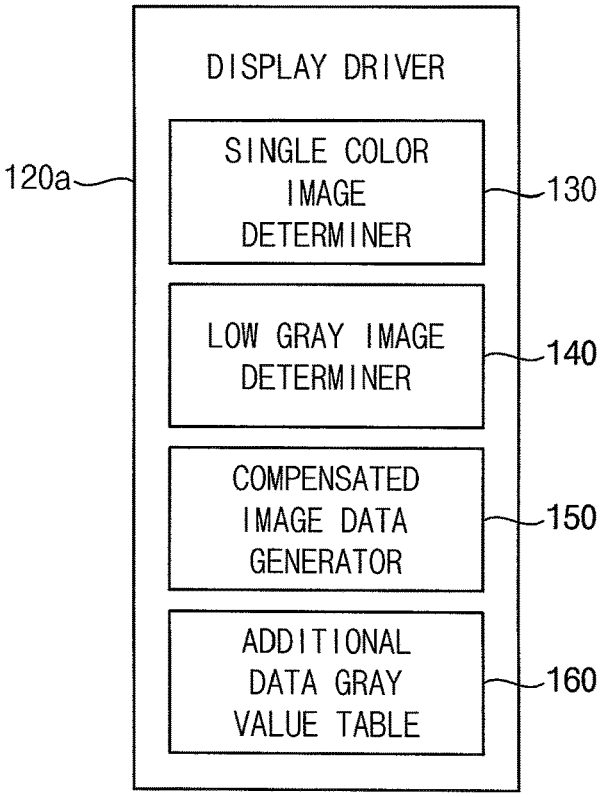
FIG. 3 is a diagram illustrating another example of a display driver included in a display device of FIG. 1.
Figure 4:
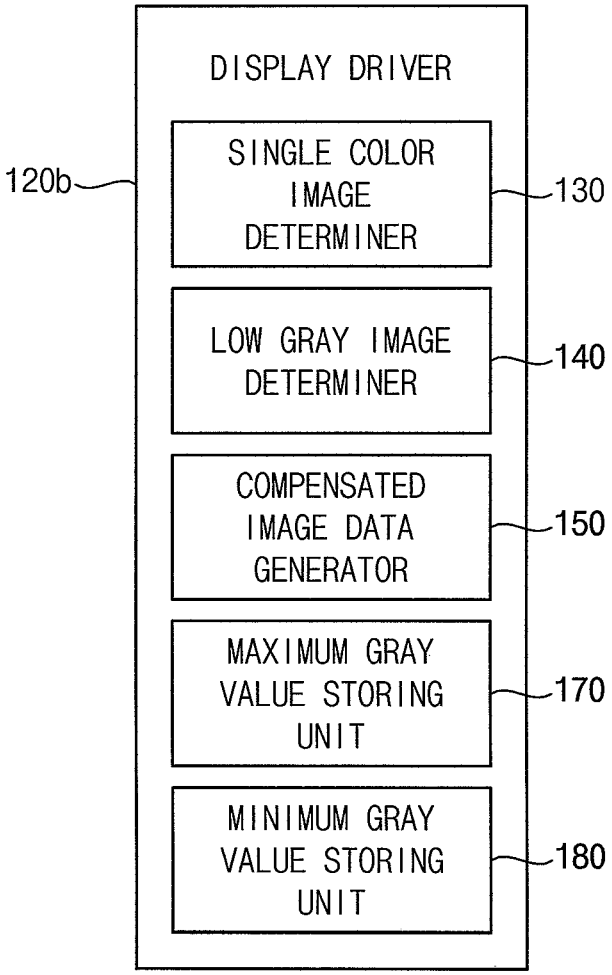
FIG. 4 is a diagram illustrating still another example of a display driver included in a display device of FIG. 1.

FIG. 1 is a block diagram illustrating a display device according to exemplary embodiments, FIG. 2 is a diagram illustrating another example of a pixel included in a display device of FIG. 1, FIG. 3 is a diagram illustrating another example of a display driver included in a display device of FIG. 1, and FIG. 4 is a diagram illustrating still another example of a display driver included in a display device of FIG. 1.

Referring to FIG. 1, a display device 100 may include a display panel 110, and a display driver 130 for driving the display panel 110.

The display panel 110 may include a plurality of pixels PX arranged in a matrix form having a plurality of rows and a plurality of columns. In some exemplary embodiments, the display panel 110 may be, but not limited to, an organic light emitting diode ("OLED") display panel. In some exemplary embodiments, the display panel 110 may be a liquid crystal display ("LCD") panel, a plasma display panel ("PDP"), or the like, for example.

Each pixel PX of the display panel 110 may include a plurality of sub-pixels 111, 112 and 113 that emit different color lights. In an exemplary embodiment, each pixel PX may include first through third sub-pixels 111, 112 and 113 that emit different color lights, for example. In some exemplary embodiments, as illustrated in FIG. 1, each pixel PX may be an RGB pixel including a red sub-pixel 111 that emits red light, a green sub-pixel 112 that emits green light, and a blue sub-pixel 113 that emits blue light. In other exemplary embodiments, as illustrated in FIG. 2, each pixel PX (or adjacent two pixels PX) may be an RGBG pixel including a red sub-pixel 116, a first green sub-pixel 117, a blue sub-pixel 118 and a second green sub-pixel 119. However, the pixel PX according to exemplary embodiments may not be limited to the RGB pixel illustrated in FIG. 1 and the RGBG pixel illustrated in FIG. 2.

The display driver 130 may drive the display panel 110 by applying data signals SDAT, scan signals, etc., to the display panel 110. In some exemplary embodiments, the display driver 130 may include, but not limited to, a data driver that provides the data signals SDAT to the display panel 110, a scan driver that provides the scan signals to the display panel 110 and a timing controller that controls operating timings of the data driver and the scan driver. In some exemplary embodiments, the display driver 130 may be implemented as a single integrated circuit ("IC"). In an exemplary embodiment, the display driver 130 may be implemented as a timing controller embedded driver ("TED") including the timing controller, for example. In other exemplary embodiments, the display driver 130 may implemented with two or more ICs.

The display driver 120 according to exemplary embodiments may perform luminance compensation on a low gray (or low luminance) single color image. In an exemplary embodiment, the display driver 120 may determine whether an image represented by input image data IDATA is a single color image that is displayed such that only one (e.g., the first sub-pixel 111) of the first through third color sub-pixels 111, 112 and 113 emits light, may determine whether the image represented by the input image data IDATA is a low gray image lower than a reference gray level value, may generate compensated image data by adding sub-pixel data (e.g., at least one of sub-pixel data for the second sub-pixel 112 and sub-pixel data for the third sub-pixel 113) for at least one of the remaining two of the first through third color sub-pixels 111, 112 and 113 not emitting light to the input image data IDATA when the image represented by the input image data IDATA is the single color image and the low gray image, and may drive the display panel 110 by providing the data signals SDAT corresponding to the compensated image data, for example.

In some exemplary embodiments, to perform the luminance compensation on the low gray single color image, the display driver may include a single color image determiner 130, a low gray image determiner 140 and a compensated image data generator 150.

The single color image determiner 130 may determine that the image represented by the input image data IDATA is the single color image when one of first through third sub-pixel data included in the input image data IDATA respectively for the first through third color sub-pixels 111, 112 and 113 have a gray level value other than 0 and the remaining two of the first through third sub-pixel data have a gray level value of 0. In an exemplary embodiment, the input image data IDATA may include red sub-pixel data for the red sub-pixel 111, green sub-pixel data for the green sub-pixel 112, and blue sub-pixel data for the blue sub-pixel 113, and the single color image determiner 130 may determine that the image represented by the input image data IDATA is a single red image when the red sub-pixel data have a gray level value other than 0 and the green and blue sub-pixel data have a gray level value of 0, for example.

The low gray image determiner 140 may determine that the image represented by the input image data IDATA is the low gray image when gray level values of the input image data IDATA are lower than the reference gray level value. In some exemplary embodiments, the reference gray level value may be a predetermined constant value. In an exemplary embodiment, the low gray image determiner 140 may determine that the image represented by the input image data IDATA is the low gray image when the gray level values of the input image data IDATA are lower than 50, for example. In other exemplary embodiments, the reference gray level value may be changed according to a dimming level of the display device 100. That is, the reference gray level value may be determined in proportion to the dimming level of the display device 100. In an exemplary embodiment, the reference gray level value at the dimming level corresponding to a relatively high luminance may be greater than the reference gray level value at the dimming level corresponding to a relatively low luminance, for example.

In some exemplary embodiments, the single color image determiner 130 may first perform the single color image determination, and then the low gray image determiner 140 may perform the low gray image determination. In other exemplary embodiments, the low gray image determiner 140 may first perform the low gray image determination, and then the single color image determiner 130 may perform the single color image determination. In still other exemplary embodiments, the single color image determiner 130 and the low gray image determiner 140 may substantially simultaneously perform the single color image determination and the low gray image determination.

The compensated image data generator 150 may output the input image data IDATA as the compensated image data when the image represented by the input image data IDATA is not the single color image or when the image represented by the input image data IDATA is not the low gray image. The compensated image data generator 150 may generate the compensated image data by adding the sub-pixel data corresponding to a color different from a color of the single color image to the input image data IDATA when the image represented by the input image data IDATA is the single color image and the low gray image. In an exemplary embodiment, when the image represented by the input image data IDATA is a single red image that is displayed such that only the red sub-pixel 111 emits light, the compensated image data generator 150 may add at least one of sub-pixel data for the green sub-pixel 112 and sub-pixel data for the blue sub-pixel 113 to the input image data IDATA to generate the compensated image data, for example.

In some exemplary embodiments, the sub-pixel data added to the input image data IDATA to generate the compensated image data may have a gray level value of 1. In an exemplary embodiment, even when the image represented by the input image data IDATA is the single red image, the data signal SDAT (e.g., 1-gray level data voltage) corresponding to the gray level value of 1 may be applied to the green sub-pixel 112 and/or the blue sub-pixel 113.

In other exemplary embodiments, the sub-pixel data added to the input image data IDATA to generate the compensated image data may have a gray level value greater than 0 and less than or equal to 1. In an exemplary embodiment, the sub-pixel data added to the input image data IDATA may have a gray level value of about 0.7, for example. In this case, even when the image represented by the input image data IDATA is the single red image, the data signal SDAT (e.g., 0.7-gray level data voltage) corresponding to the gray level value of about 0.7 may be applied to the green sub-pixel 112 and/or the blue sub-pixel 113. In an exemplary embodiment, to generate the data signal SDAT corresponding to the gray level value of about 0.7, the data driver of the display driver 120 may include, but not limited to, a voltage divider that divides the 1-gray level data voltage (or between the 1-gray level data voltage and 0-gray level data voltage), for example.

In still other exemplary embodiments, the sub-pixel data added to the input image data IDATA to generate the compensated image data may have a gray level value that is proportional to a gray level value (e.g., a maximum gray level value or an average gray level value) of the input image data IDATA. In an exemplary embodiment, when the input image data IDATA includes sub-pixel data having gray level values other than 0 with respect to the red sub-pixel 111, or when the input image data IDATA represents the single red image, a gray level of sub-pixel data for the green sub-pixel 112 and/or the blue sub-pixel 113 added to the input image data IDATA may be proportional to the gray level value (e.g., the maximum gray level value or the average gray level value) of the sub-pixel data for the red sub-pixel 111, for example.

In still other exemplary embodiments, the sub-pixel data added to the input image data IDATA to generate the compensated image data may have a gray level value that is proportional to the dimming level of the display device 100. In an exemplary embodiment, when the image represented by the input image data IDATA is the single red image, a gray level of sub-pixel data for the green sub-pixel 112 and/or the blue sub-pixel 113 added to the input image data IDATA may be relatively high at the dimming level corresponding to a relatively high luminance, and may be relatively low at the dimming level corresponding to a relatively low luminance, for example.

In some exemplary embodiments, to determine the gray level value of the sub-pixel data added to the input image data IDATA in proportion to the gray level value of the input image data IDATA and/or the diming level of the display device 100, as illustrated in FIG. 3, the display driver 120*a* may further include an additional data gray value table 160 that stores the gray level value of the sub-pixel data added to the input image data IDATA according to the gray level value of the input image data or the dimming level of the display device 100. In an exemplary embodiment, the additional data gray value table 160 may be implemented as a lookup table storing the gray level value corresponding to the gray level value of the input image data IDATA and/or the diming level of the display device 100, for example. The compensated image data generator 150 may generate the compensated image data by adding the sub-pixel data having the gray level value stored in the additional data gray value table 160 to the input image data IDATA.

In other exemplary embodiments, to determine the gray level value of the sub-pixel data added to the input image data IDATA in proportion to the gray level value of the input image data IDATA and/or the diming level of the display device 100, as illustrated in FIG. 4, the display driver 120*b* may further include a maximum gray value storing unit 170 that stores a maximum additional data gray level value corresponding to a maximum gray level value (e.g., a maximum possible gray level value of the input image data IDATA with respect to the low gray single color image) and/or a maximum dimming level, and a minimum gray value storing unit 180 that stores a minimum additional data gray level value corresponding to a minimum gray level value (e.g., a minimum possible gray level value of the input image data IDATA with respect to the low gray single color image) and/or a minimum dimming level. The compensated image data generator 150 may calculate an additional data gray level value corresponding to the gray level value of the input image data IDATA or the dimming level of the display device 100 by performing a linear interpolation between the maximum additional data gray level value of the maximum gray value storing unit 170 and the minimum additional data gray level value of the minimum gray value storing unit 180, and may generate the compensated image data by adding the sub-pixel data having the calculated additional data gray level value to the input image data IDATA. Although FIGS. 3 and 4 illustrate examples of the display drivers 120*a* and 120*b*, the display driver 120 according to exemplary embodiments may not be limited to the examples of FIGS. 3 and 4.

In a conventional display device, such as a conventional organic light emitting display device, a single color image may not have desired luminance because of coupling between a pixel emitting light and an adjacent pixel not emitting light. In particular, when a low gray single color image or a low luminance single color image is displayed, a gradation aggregation phenomenon in which image portions corresponding to adjacent low gray levels are not distinguished may occur.

However, as described above, the display device 100 according to exemplary embodiments may determine whether the image represented by the input image data IDATA is the single color image and the low gray image, and may add sub-pixel data corresponding to a color different from a color of the single color image in case of the low gray single color image, thereby improving an image quality of the low gray single color image by compensating for the luminance degradation of the low gray single color image.

Figure 5:
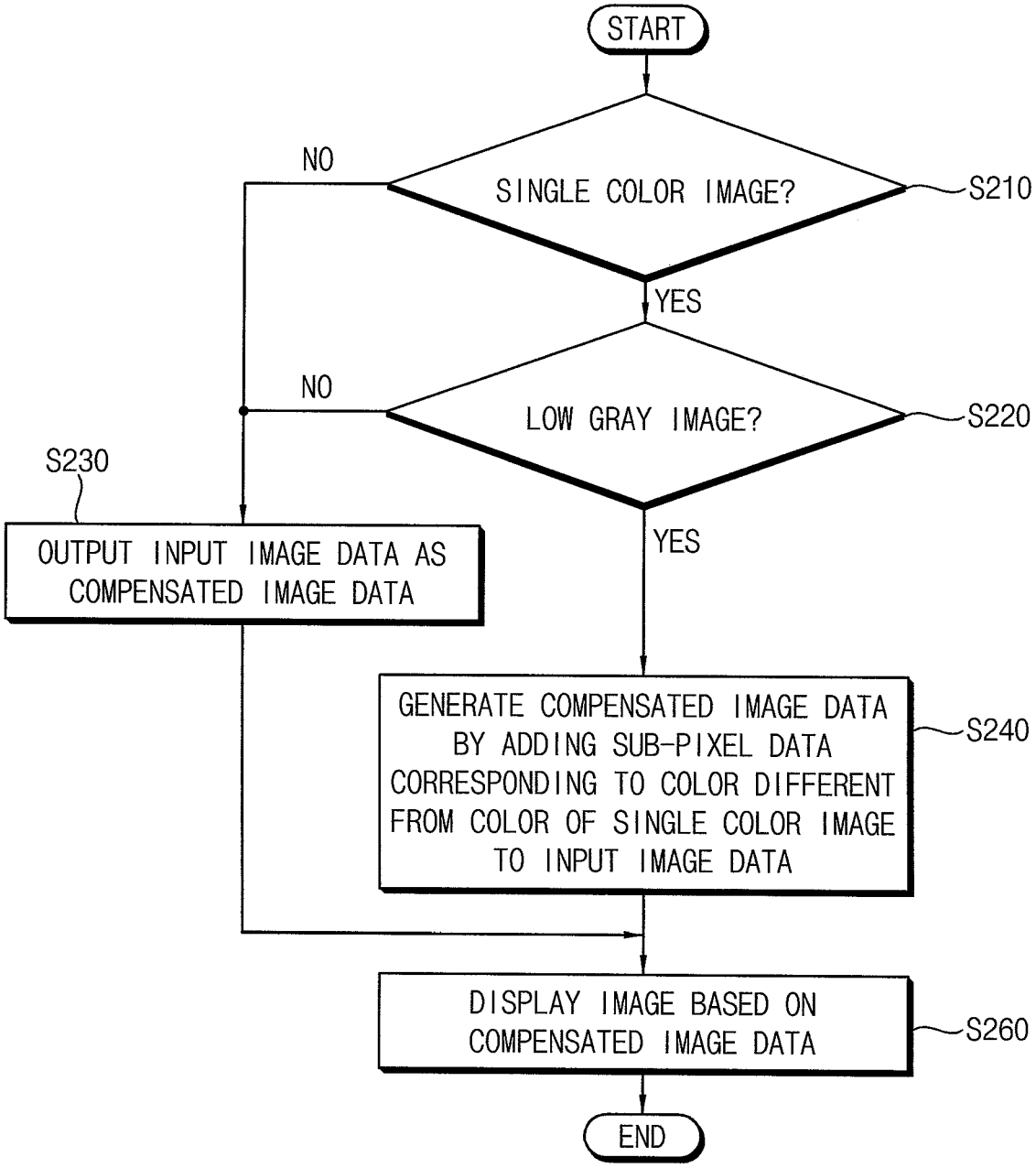
FIG. 5 is a flowchart illustrating an exemplary embodiment of a method of operating a display device.
Figure 6:
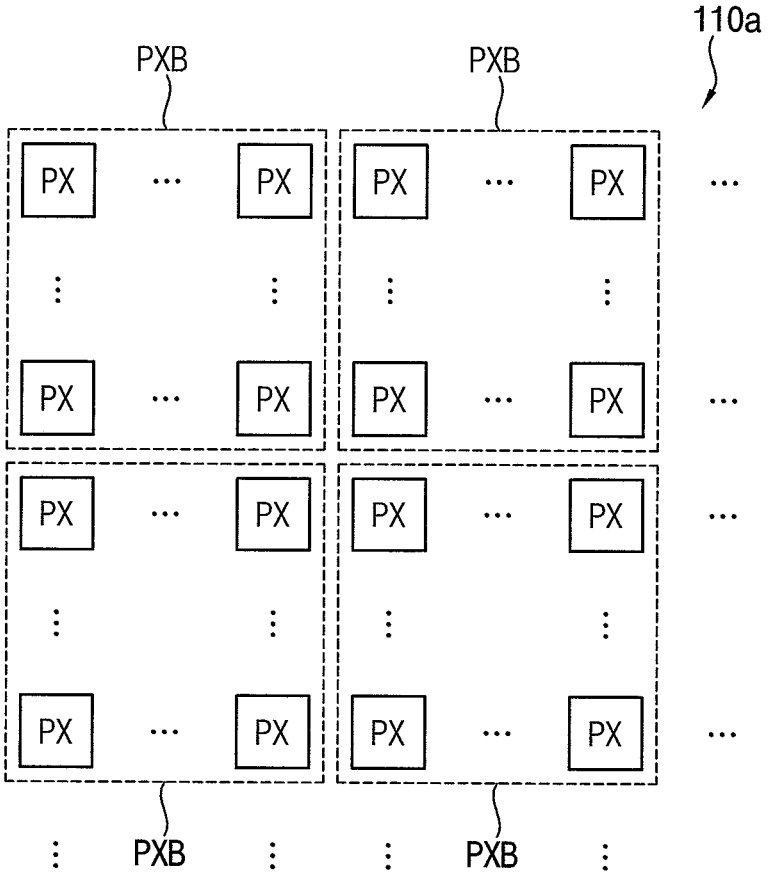
FIG. 6 is a diagram for describing an example of a pixel block on which low gray single color image is performed.

FIG. 5 is a flowchart illustrating a method of operating a display device according to exemplary embodiments, and FIG. 6 is a diagram for describing an example of a pixel block on which low gray single color image is performed.

Referring to FIGS. 1 and 5, a display driver 120 may determine whether an image represented by input image data IDATA is a single color image (S210). In some exemplary embodiments, the input image data IDATA may include red sub-pixel data for a red sub-pixel 111, green sub-pixel data for a green sub-pixel 112, and blue sub-pixel data for a blue sub-pixel 113, and a single color image determiner 130 of the display driver 120 may determine that the image represented by the input image data IDATA is the single color image when one of the red, green and blue sub-pixel data have a gray level value other than 0 and the remaining two of the red, green and blue sub-pixel data have a gray level value of 0.

If the image represented by the input image data IDATA is the single color image (S210: YES), the display driver 120 may determine whether the image represented by the input image data IDATA is a low gray image (S220). In an exemplary embodiment, a low gray image determiner 140 of the display driver 120 may determine that the image represented by the input image data IDATA is the low gray image when gray level values of the input image data IDATA are lower than a reference gray level value, for example. In some exemplary embodiments, the reference gray level value may be a predetermined constant value. In other exemplary embodiments, the reference gray level value may be changed according to a dimming level of a display device 100.

When the image represented by the input image data IDATA is not the single color image (S210: NO) or when the image represented by the input image data is not the low gray image (S220: NO), the display driver 120 may generate compensated image data substantially the same as the input image data IDATA (S230). In an exemplary embodiment, a compensated image data generator 150 of the display driver 120 may output the input image data IDATA as the compensated image data, for example.

When the image represented by the input image data IDATA is the single color image and the low gray image (S210: YES and S220: YES), the display driver 120 may generate the compensated image data by adding sub-pixel data corresponding to a color different from a color of the single color image to the input image data IDATA (S240). In an exemplary embodiment, when the image represented by the input image data IDATA is a single red image, the compensated image data generator 150 of the display driver 120 may generate the compensated image data by adding green sub-pixel data and/or blue sub-pixel data to the input image data IDATA, for example. In some exemplary embodiments, the sub-pixel data added to the input image data IDATA may have a gray level value of 1. In other exemplary embodiments, the sub-pixel data added to the input image data IDATA may have a gray level value greater than 0 and less than or equal to 1. In still other exemplary embodiments, the sub-pixel data added to the input image data IDATA may have a gray level value that is proportional to a gray level value of the input image data IDATA. In still other exemplary embodiments, the sub-pixel data added to the input image data IDATA may have a gray level value that is proportional to the dimming level of the display device 100.

In some exemplary embodiments, the single color image determination (S210), the low gray image determination (S220) and the low gray single color image luminance compensation (S240) may be performed per each pixel PX of the display device 100. In an exemplary embodiment, when red sub-pixel data for a red sub-pixel 111 of a first pixel PX has a gray level value greater than 0 and less than the reference gray level value, and green and blue sub-pixel data for green and blue sub-pixels 112 and 113 of the first pixel PX have a gray level value of 0, the compensated image data for the first pixel PX may be generated by adding green and/or blue sub-pixel data to the input image data IDATA for the first pixel PX, for example. Further, when at least two of red, green and blue sub-pixel data for a second pixel PX have gray level values other than 0, or when at least one of the red, green and blue sub-pixel data for the second pixel PX has a gray level value greater than the reference gray level value, the compensated image data for the second pixel PX may be substantially the same as the input image data IDATA.

In other exemplary embodiments, as illustrated in FIG. 6, a plurality of pixels PX included in a display panel 110*a* of the display device 100 may be grouped into a plurality of pixel blocks PXB each including two or more pixels PX, and the single color image determination (S210), the low gray image determination (S220) and the low gray single color image luminance compensation (S240) may be performed per each pixel block PXB. In an exemplary embodiment, when an image to be displayed at a first pixel block PXB is a low gray single color image, the luminance compensation (or adding the sub-pixel data) for the first pixel block PXB may be performed. Further, when an image to be displayed at a second pixel block PXB is not the low gray single color image, the compensated image data for the second pixel block PXB may be substantially the same as the input image data IDATA, for example.

In still other exemplary embodiments, the single color image determination (S210), the low gray image determination (S220) and the low gray single color image luminance compensation (S240) may be performed, per each frame, on the entire pixels PX. In an exemplary embodiment, when red sub-pixel data for entire red sub-pixels 111 included in the display panel 110 have gray level values greater than 0 and less than the reference gray level value, and green and blue sub-pixel data for entire green and blue sub-pixels 112 and 113 included in the display panel 110 have a gray level value of 0, the luminance compensation for the entire pixels PX may be performed, for example.

The display device 100 may display an image based on the compensated image data (S260). In an exemplary embodiment, the display driver 120 may provide data signals SDAT corresponding to the compensated image data to the display panel 110, and the display panel 110 may display an image corresponding to the compensated image data in response to the data signals SDAT, for example. Accordingly, when the low gray single color image is displayed in the display device 100, the sub-pixel data corresponding to the color different from the color of the single color image may be added to the input image data IDATA, thereby improving an image quality of the low gray single color image.

Figure 7:
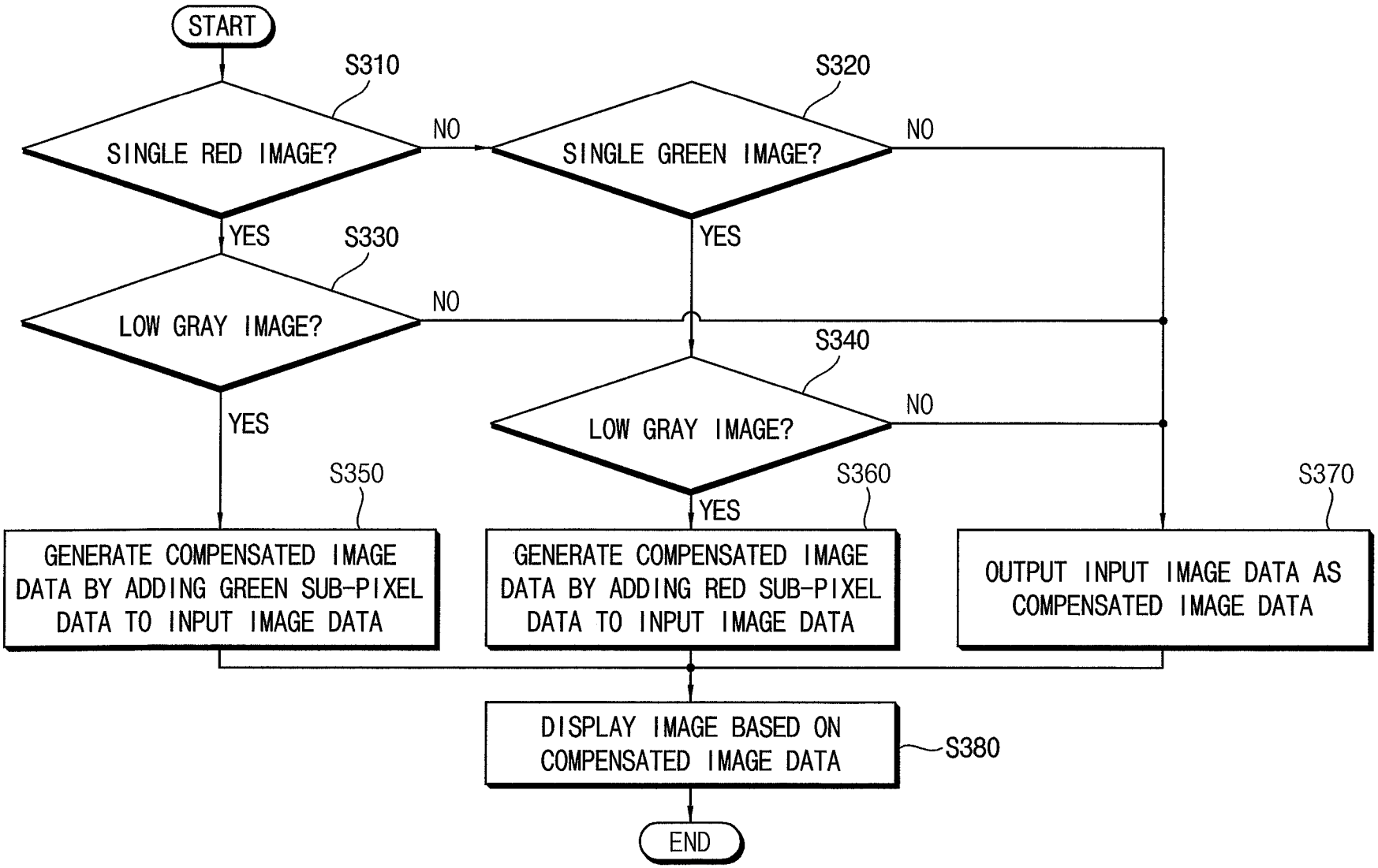
FIG. 7 is a flowchart illustrating an exemplary embodiment of a method of operating a display device.
Figure 8:
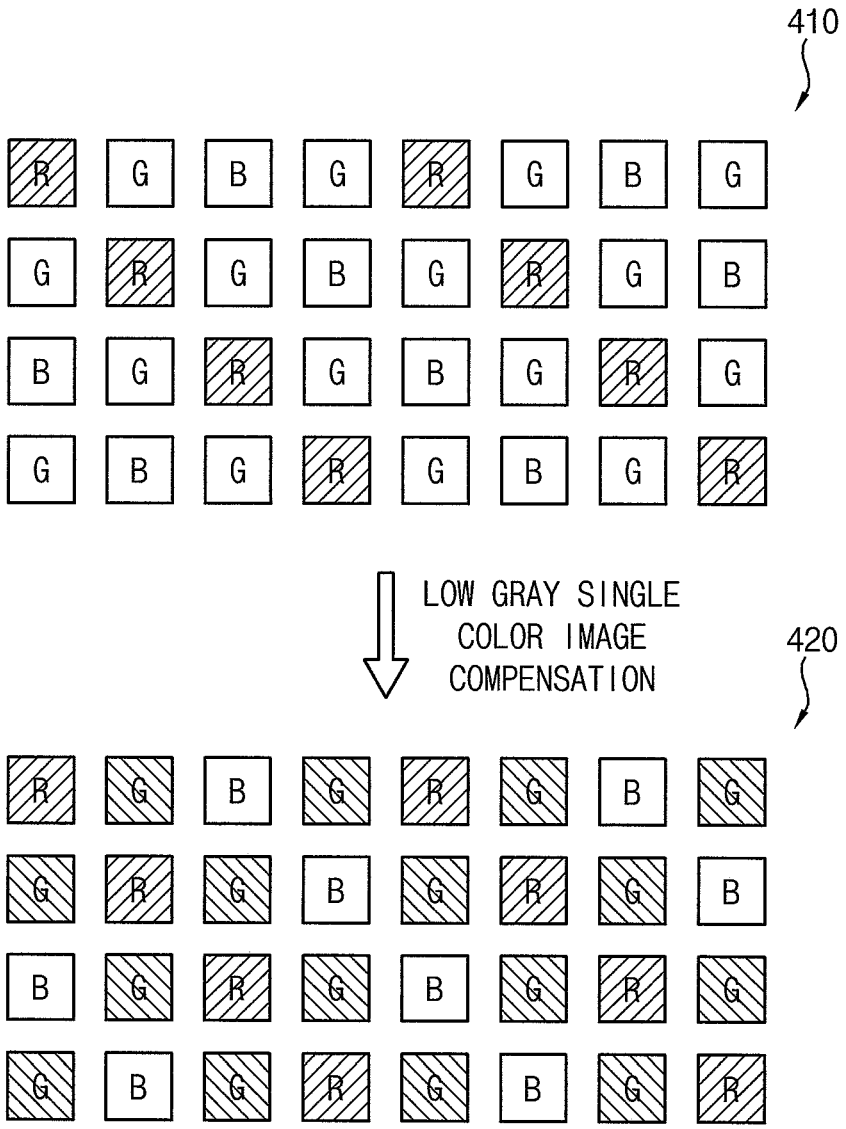
FIG. 8 is a diagram for describing an example where a low gray single red image is compensated by a method of FIG. 7.
Figure 9:
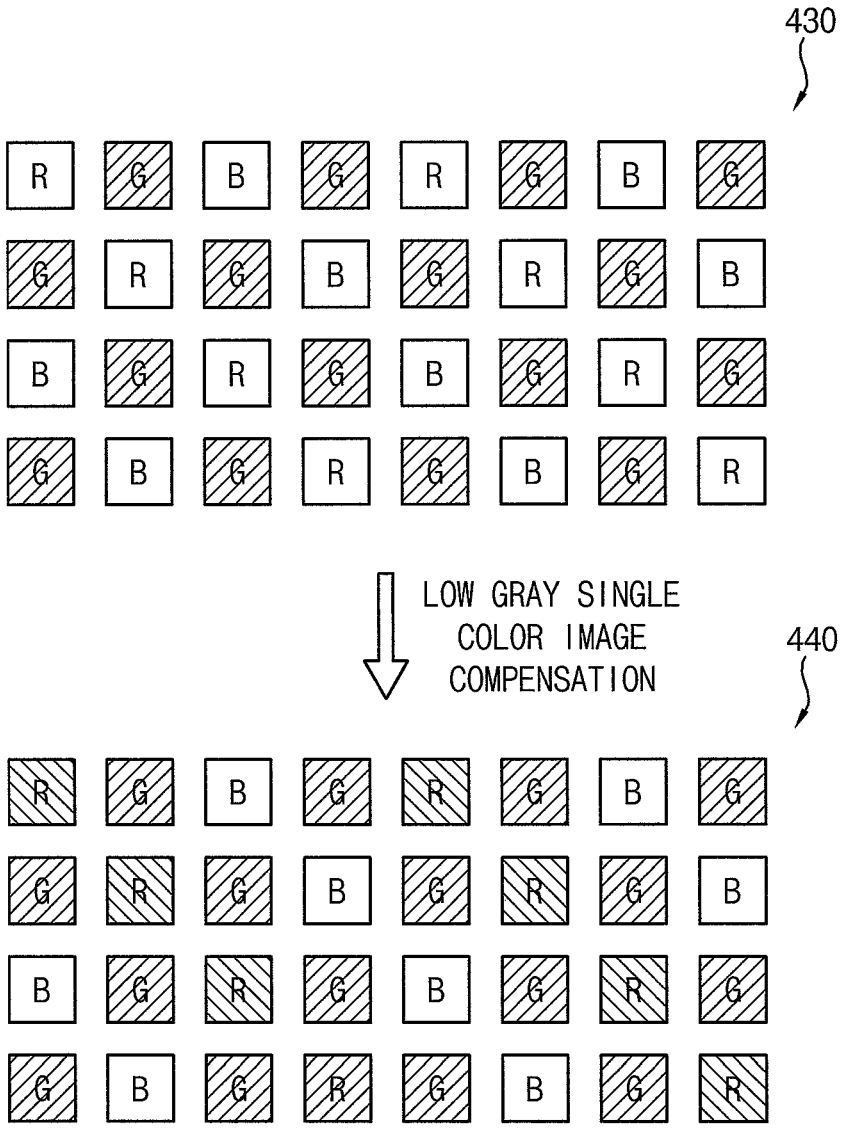
FIG. 9 is a diagram for describing an example where a low gray single green image is compensated by a method of FIG. 7.

FIG. 7 is a flowchart illustrating a method of operating a display device according to exemplary embodiments, FIG. 8 is a diagram for describing an example where a low gray single red image is compensated by a method of FIG. 7, and FIG. 9 is a diagram for describing an example where a low gray single green image is compensated by a method of FIG. 7.

Referring to FIGS. 1 and 7, a display driver 120 may determine whether an image represented by input image data IDATA is a single red image (S310) or a single green image (S320). When the image represented by the input image data IDATA is the single red image (S310: YES) or the single green image (S320: YES), the display driver 120 may determine whether the image represented by the input image data IDATA is a low gray image (S330 and S340).

When the image represented by the input image data IDATA is neither the single red image nor the single green image (S310: NO and S320: NO), or when the image represented by the input image data is not the low gray image (S330: NO or S340: NO), the display driver 120 may generate compensated image data substantially the same as the input image data IDATA (S370).

When the image represented by the input image data IDATA is a low gray single red image (S310: YES and S330: YES), the display driver 120 may generate the compensated image data by adding green sub-pixel data to the input image data IDATA (S350), and the display device 100 may display an image based on the compensated image data (S380).

In an exemplary embodiment, as illustrated in FIG. 8, when the image 410 represented by the input image data IDATA is the low gray single red image that is displayed such that only red sub-pixels R among the red sub-pixels R, green sub-pixels G and blue sub-pixels B emit light, the display device 100 according to exemplary embodiments may perform the low gray single color image compensation that adds the green sub-pixel data (e.g., having a gray level value of 1) to the input image data IDATA, and thus may display a compensated low gray single red image 420 by allowing the red sub-pixels R and the green sub-pixels G to emit light, for example. Accordingly, luminance degradation of the low gray single red image 420 may be compensated, and an image quality of the low gray single red image 420 may be improved.

Further, when the image represented by the input image data IDATA is a low gray single green image (S320: YES and S340: YES), the display driver 120 may generate the compensated image data by adding red sub-pixel data to the input image data IDATA (S360), and the display device 100 may display an image based on the compensated image data (S380).

In an exemplary embodiment, as illustrated in FIG. 9, when the image 430 represented by the input image data IDATA is the low gray single green image that is displayed such that only the green sub-pixels G among the red sub-pixels R, the green sub-pixels G and the blue sub-pixels B emit light, the display device 100 according to exemplary embodiments may perform the low gray single color image compensation that adds the red sub-pixel data (e.g., having the gray level value of 1) to the input image data IDATA, and thus may display a compensated low gray single green image 440 by allowing the red sub-pixels R and the green sub-pixels G to emit light, for example. Accordingly, luminance degradation of the low gray single green image 440 may be compensated, and an image quality of the low gray single red image 440 may be improved.

In some exemplary embodiments, a low gray single blue image may be displayed with sufficient luminance, and thus compensation for luminance degradation of the low gray single blue image may not be desired.

Figure 10:
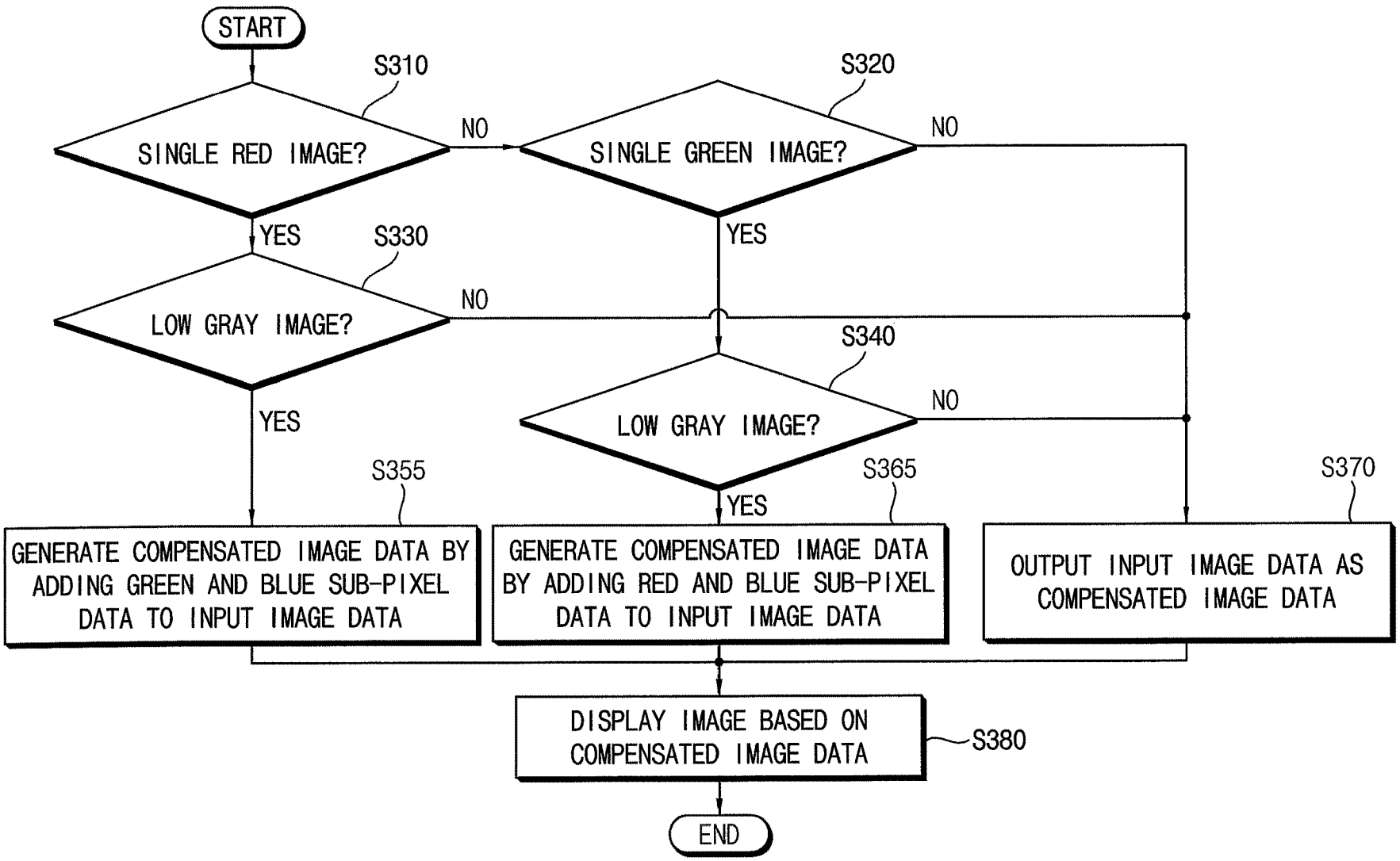
FIG. 10 is a flowchart illustrating an exemplary embodiment of a method of operating a display device.
Figure 11:
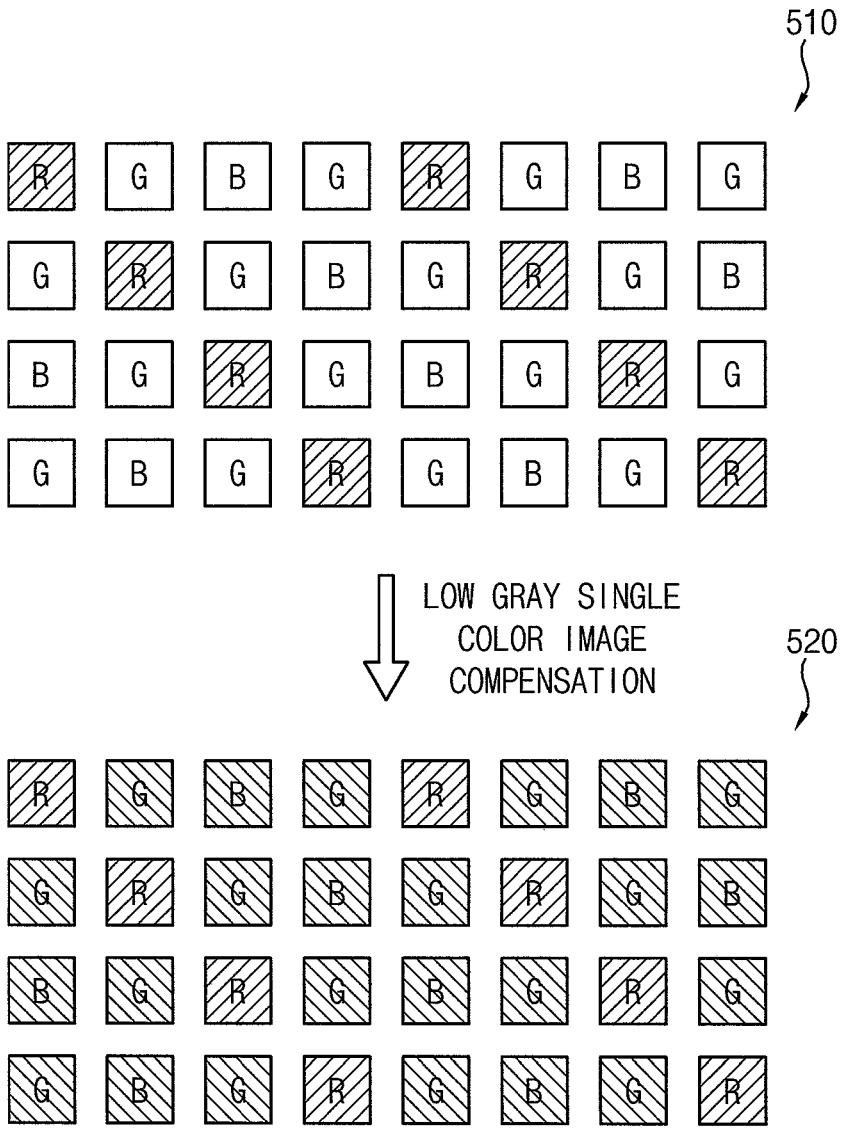
FIG. 11 is a diagram for describing an example where a low gray single red image is compensated by a method of FIG. 10.
Figure 12:
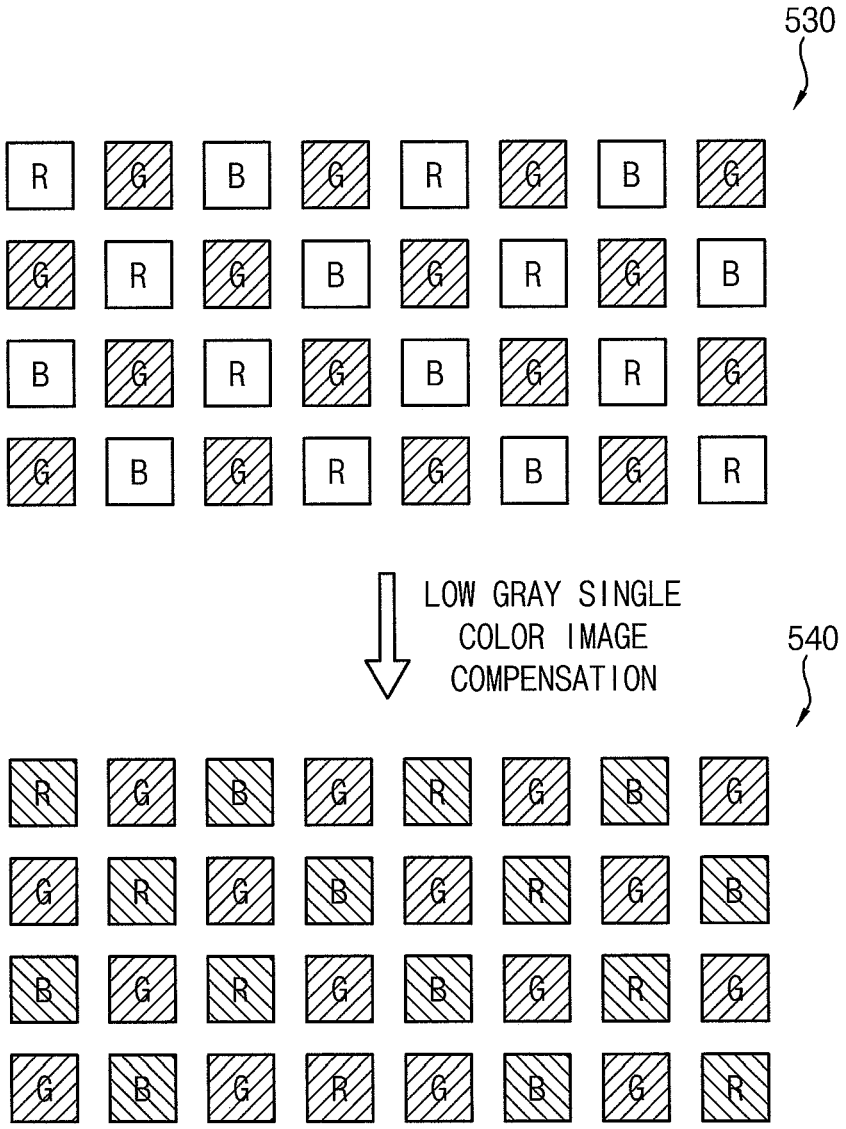
FIG. 12 is a diagram for describing an example where a low gray single green image is compensated by a method of FIG. 10.

FIG. 10 is a flowchart illustrating a method of operating a display device according to exemplary embodiments, FIG. 11 is a diagram for describing an example where a low gray single red image is compensated by a method of FIG. 10, and FIG. 12 is a diagram for describing an example where a low gray single green image is compensated by a method of FIG. 10.

A method of FIG. 10 may be substantially the same as a method of FIG. 7, except for an operation (S355) of compensating a low gray single red image and an operation (S365) of compensating a low gray single green image.

Referring to FIGS. 1 and 10, when an image represented by input image data IDATA is the low gray single red image (S310: YES and S330: YES), a display driver 120 may generate the compensated image data by adding green sub-pixel data and blue sub-pixel data to the input image data IDATA (S355), and a display device 100 may display an image based on the compensated image data (S380).

In an exemplary embodiment, as illustrated in FIG. 11, when the image 510 represented by the input image data IDATA is the low gray single red image that is displayed such that only red sub-pixels R among the red sub-pixels R, green sub-pixels G and blue sub-pixels B emit light, the display device 100 according to exemplary embodiments may perform the low gray single color image compensation that adds the green sub-pixel data (e.g., having a gray level value of 1) and the blue sub-pixel data (e.g., having the gray level value of 1) to the input image data IDATA, and thus may display a compensated low gray single red image 520 by allowing the red sub-pixels R, the green sub-pixels G and the blue sub-pixels B to emit light, for example. When only the green sub-pixel data are added to the input image data IDATA for the low gray single red image as illustrated in FIG. 7, the low gray single red image may become yellowish. However, the method of operating the display device 100 illustrated in FIG. 10 may add not only the green sub-pixel data but also the blue sub-pixel data to the input image data IDATA. Accordingly, luminance degradation of the low gray single red image 520 may be compensated, and a color coordinate of the low gray single red image 520 may not be substantially changed.

Further, when the image represented by the input image data IDATA is a low gray single green image (S320: YES and S340: YES), the display driver 120 may generate the compensated image data by adding red sub-pixel data and blue sub-pixel data to the input image data IDATA (S365), and the display device 100 may display an image based on the compensated image data (S380).

In an exemplary embodiment, as illustrated in FIG. 12, when the image 530 represented by the input image data IDATA is the low gray single green image that is displayed such that only the green sub-pixels G among the red sub-pixels R, the green sub-pixels G and the blue sub-pixels B emit light, the display device 100 according to exemplary embodiments may perform the low gray single color image compensation that adds the red sub-pixel data (e.g., having the gray level value of 1) and the blue sub-pixel data (e.g., having the gray level value of 1) to the input image data IDATA, and thus may display a compensated low gray single green image 540 by allowing the red sub-pixels R, the green sub-pixels G and the blue sub-pixels B to emit light, for example. Accordingly, luminance degradation of the low gray single green image 540 may be compensated, and a color coordinate of the low gray single green image 540 may not be substantially changed.

Figure 13:
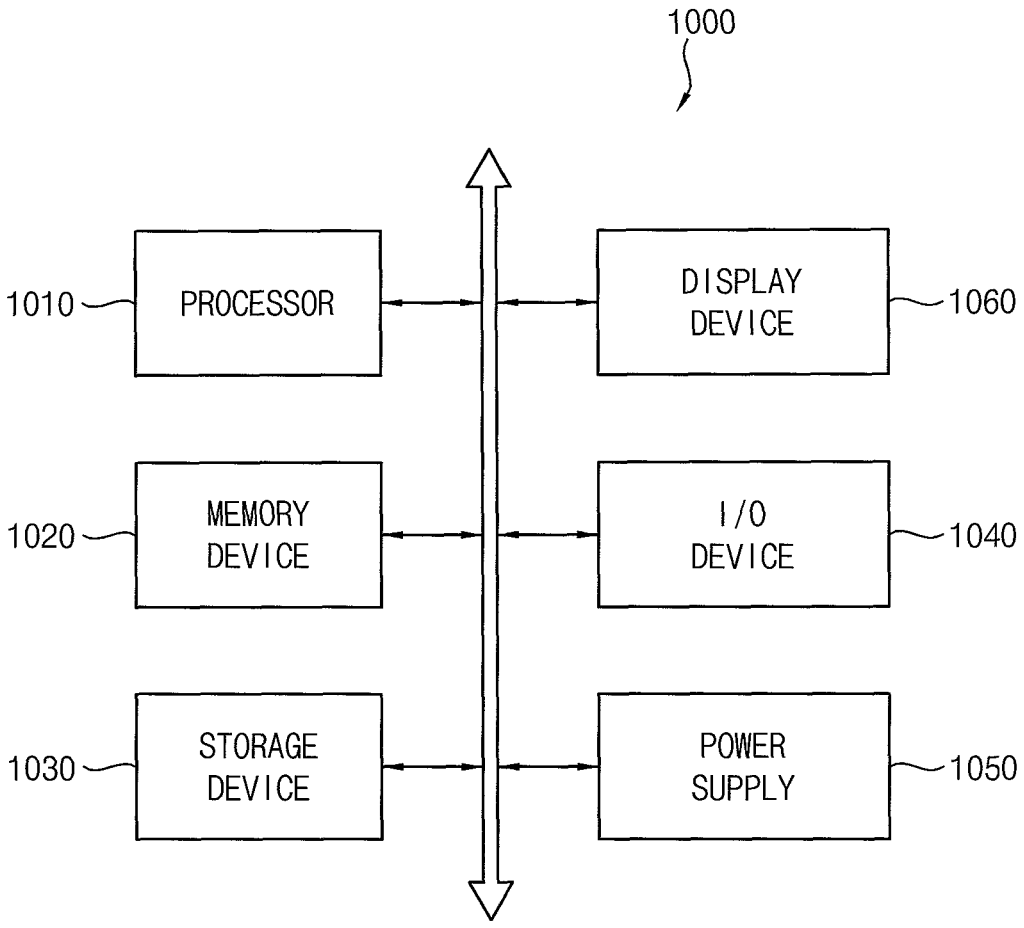
FIG. 13 is a block diagram illustrating an exemplary embodiment of an electronic device including a display device.

FIG. 13 is a block diagram illustrating an electronic device including a display device according to exemplary embodiments.

Referring to FIG. 13, an electronic device 1000 may include a processor 1010, a memory device 1020, a storage device 1030, an input/output ("I/O") device 1040, a power supply 1050 and a display device 1060. In an exemplary embodiment, the electronic device 1000 may further include a plurality of ports for communicating a video card, a sound card, a memory card, a universal serial bus ("USB") device, other electronic devices, etc., for example.

The processor 1010 may perform various computing functions or tasks. In some exemplary embodiments, processor 1010 may be an application processor ("AP"), a central processing unit ("CPU"), a graphics processing unit ("GPU"), a micro processor, etc., for example. In an exemplary embodiment, the processor 1010 may be coupled to other components via an address bus, a control bus, a data bus, etc., for example. Further, in an exemplary embodiment, the processor 1010 may be coupled to an extended bus such as a peripheral component interconnection ("PCI") bus.

The memory device 1020 may store data for operations of the electronic device 1000. In an exemplary embodiment, the memory device 1020 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc., and/or at least one volatile memory device such as a dynamic random access memory ("DRAM") device, a static random access memory ("SRAM") device, a mobile DRAM device, etc., for example.

In an exemplary embodiment, the storage device 1030 may be a solid state drive ("SSD") device, a hard disk drive ("HDD") device, a CD-ROM device, etc., for example. In an exemplary embodiment, the I/O device 1040 may be an input device such as a keyboard, a keypad, a mouse device, a touchpad, a touch-screen, a remote controller, etc., and an output device such as a printer, a speaker, etc. The power supply 1050 may provide power for operations of the electronic device 1000. The display device 1060 may be coupled to other components via the buses or other communication links.

When an image represented by input image data is a single color image and a low gray image, the display device 1060 may add sub-pixel data corresponding to a color different from a color of the single color image, thereby improving an image quality of a low gray single color image.

The invention may be applied to a display device 1060 and any electronic device 1000 including the display device 1060. In an exemplary embodiment, the invention may be applied to a television ("TV"), a digital TV, a three-dimensional ("3D") TV, a smart phone, a mobile phone, a tablet computer, a personal computer ("PC"), a home appliance, a laptop computer, a personal digital assistant ("PDA"), a portable multimedia player ("PMP"), a digital camera, a music player, a portable game console, a navigation device, etc., for example.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A method of operating a display device, the method comprising:

determining whether an image represented by input image data is a single color image;

determining whether the image represented by the input image data is a low gray image;

generating compensated image data by adding non-zero sub-pixel data corresponding to a color different from a color of the single color image to the input image data when the image represented by the input image data is the single color image and the low gray image; and display an image based on the compensated image data, wherein the input image data include first sub-pixel data for a first color sub-pixel, second sub-pixel data for a second color sub-pixel, and third sub-pixel data for a third color sub-pixel, and wherein the determining whether the image represented by the input image data is the single color image includes:

determining that the image represented by the input image data is the single color image when one of the first through third sub-pixel data has a gray level value other than 0 and remaining two of the first through third sub-pixel data have a gray level value of 0.

2. The method of claim 1, wherein the determining whether the image represented by the input image data is the low gray image includes:

determining that the image represented by the input image data is the low gray image when gray level values of the input image data are lower than a reference gray level value.

3. The method of claim 2, wherein the reference gray level value is a predetermined constant value.

4. The method of claim 2, wherein the reference gray level value is changed according to a dimming level of the display device.

5. The method of claim 1, wherein the generating the compensated image data includes:

outputting the input image data as the compensated image data when the image represented by the input image data is not the single color image or when the image represented by the input image data is not the low gray image.

6. The method of claim 1, wherein the sub-pixel data added to the input image data have a gray level value of 1.

7. The method of claim 1, wherein the sub-pixel data added to the input image data have a gray level value greater than 0 and less than or equal to 1.

8. The method of claim 1, wherein the sub-pixel data added to the input image data have a gray level value which is proportional to a gray level value of the input image data.

9. The method of claim 1, wherein the sub-pixel data added to the input image data have a gray level value which is proportional to a dimming level of the display device.

10. The method of claim 1, wherein the generating the compensated image data includes:

generating the compensated image data by adding green sub-pixel data to the input image data when the image represented by the input image data is a single red image; and generating the compensated image data by adding red sub-pixel data to the input image data when the image represented by the input image data is a single green image.

11. The method of claim 1, wherein the generating the compensated image data includes:

generating the compensated image data by adding green sub-pixel data and blue sub-pixel data to the input image data when the image represented by the input image data is a single red image; and generating the compensated image data by adding red sub-pixel data and the blue sub-pixel data to the input image data when the image represented by the input image data is a single green image.

12. The method of claim 1, wherein the determining whether the image is the single color image, the determining whether the image is the low gray image and the generating the compensated image data are performed per each pixel of the display device.

13. The method of claim 1, wherein a plurality of pixels of the display device is grouped into a plurality of pixel blocks, and wherein the determining whether the image is the single color image, the determining whether the image is the low gray image and the generating the compensated image data are performed per each pixel block.

14. The method of claim 1, wherein the determining whether the image is the single color image, the determining whether the image is the low gray image and the generating the compensated image data are performed per each frame of the display device.

15. A method of operating a display device including a first color sub-pixel, a second color sub-pixel and a third color sub-pixel, the method comprising:

determining whether an image represented by input image data is a single color image which is displayed such that only one of the first through third color sub-pixels emits light;

determining whether the image represented by the input image data is a low gray image lower than a reference gray level value;

generating compensated image data by adding non-zero sub-pixel data for at least one of remaining two of the first through third color sub-pixels not emitting light to the input image data when the image represented by the input image data is the single color image and the low gray image; and display an image based on the compensated image data, wherein the input image data include first sub-pixel data for a first color sub-pixel, second sub-pixel data for a second color sub-pixel, and third sub-pixel data for a third color sub-pixel, and wherein the determining whether the image represented by the input image data is the single color image includes:

determining that the image represented by the input image data is the single color image when one of the first through third sub-pixel data has a gray level value other than 0 and remaining two of the first through third sub-pixel data have a gray level value of 0.

16. A display device comprising:

a display panel including a first color sub-pixel, a second color sub-pixel and a third color sub-pixel; and a display driver which drives the display panel, wherein the display driver includes a single color image determiner which determines that the image represented by the input image data is the single color image when one of first through third sub-pixel data included in the input image data respectively for the first through third color sub-pixels has a gray level value other than 0 and the remaining two of the first through third sub-pixel data have a gray level value of 0, wherein the display driver further:

determines whether an image represented by input image data is a single color image which is displayed such that only one of the first through third color sub-pixels emits light;

determines whether the image represented by the input image data is a low gray image lower than a reference gray level value;

generates compensated image data by adding non-zero sub-pixel data for at least one of remaining two of the first through third color sub-pixels not emitting light to the input image data when the image represented by the input image data is the single color image and the low gray image; and drives the display panel based on the compensated image data.

17. The display device of claim 16, wherein the display driver includes:

a low gray image determiner which determines that the image represented by the input image data is the low gray image when gray level values of the input image data are lower than the reference gray level value; and a compensated image data generator which outputs the input image data as the compensated image data when the image represented by the input image data is not the single color image or when the image represented by the input image data is not the low gray image, and generates the compensated image data by adding the sub-pixel data for at least one of the remaining two of the first through third color sub-pixels not emitting light to the input image data when the image represented by the input image data is the single color image and the low gray image.

18. The display device of claim 17, wherein the display driver further includes:

an additional data gray value table which stores a gray level value of the sub-pixel data added to the input image data according to a gray level value of the input image data or a dimming level of the display device, wherein the compensated image data generator generates the compensated image data by adding the sub-pixel data having the gray level value stored in the additional data gray value table to the input image data.

19. The display device of claim 17, wherein the display driver further includes:

a maximum gray value storing unit which stores a maximum additional data gray level value corresponding to a maximum gray level value or a maximum dimming level; and a minimum gray value storing unit which stores a minimum additional data gray level value corresponding to a minimum gray level value or a minimum dimming level, wherein the compensated image data generator calculates an additional data gray level value corresponding to a gray level value of the input image data or a dimming level of the display device by performing a linear interpolation between the maximum additional data gray level value and the minimum additional data gray level value, and generates the compensated image data by adding the sub-pixel data having the calculated additional data gray level value to the input image data.

* * * * *